US005256427A

United States Patent [19]

Quick et al.

[11] Patent Number: 5,256,427

[45] Date of Patent: Oct. 26, 1993

[54] PAPERBOARD CONTAINER HAVING POLYMETHYLPENTENE COATING

[75] Inventors: James R. Quick, Greenwood Lake, N.Y.; James E. Martin, Mason, Ohio

[73] Assignee: International Paper Company, Purchase, N.Y.

[21] Appl. No.: 747,834

[22] Filed: Aug. 21, 1991

[51] Int. Cl.[5] ..... A21D 10/02

[52] U.S. Cl. ..... 426/106; 426/113; 220/458; 229/190; 229/903; 428/35.7

[58] Field of Search ..... 426/106, 127, 126, 113; 229/190, 903; 220/458; 428/479.6, 457.8, 35.7

[56] References Cited

U.S. PATENT DOCUMENTS

| | | | |
|---|---|---|---|
| 2,648,097 | 8/1953 | Kritchever . | |
| 2,767,103 | 10/1956 | Loukomsky . | |
| 4,316,070 | 2/1982 | Prosise et al. . | |
| 4,622,237 | 11/1986 | Lori . | |
| 4,757,940 | 7/1988 | Quick et al. | 229/3.5 R |
| 4,818,325 | 4/1989 | Hiraiwa et al. . | |
| 4,828,136 | 5/1989 | Kawahara et al. . | |
| 4,830,863 | 5/1989 | Jones | 426/127 |
| 4,853,253 | 8/1989 | Katoh . | |
| 4,869,372 | 9/1989 | Wyberg | 229/3.5 R |
| 4,896,788 | 1/1990 | Bolte et al. . | |
| 4,952,293 | 8/1990 | Sypula et al. . | |
| 5,002,833 | 3/1991 | Kinsey et al. | 426/127 |

OTHER PUBLICATIONS

Bakker "The Wiley Encyclopedia of Packaging Technology" John Wiley & Sons Publishing (1986) pp. 457–458 and 620–622.

*Primary Examiner*—R. B. Penland
*Attorney, Agent, or Firm*—Michael J. Doyle

[57] ABSTRACT

A blank for a paperboard container is provided on one of its surfaces with a layer of food-contacting polymethylpentene. The container formed from the blank, as by bending the blank along fold lines, requires one or more overlapped joints such as the usual manufacturer's joint. To overcome the non-stick properties of the polymethylpentene layer, the layer is flame treated so that it will adhere to a conventional water based, FDA approved adhesive and thereby make possible the formation of a seam or other overlapped joint or joints. Flame treatment is restricted to portions of the area of the polymethylpentene layer that are involved in the formation of the overlapped joint or joints.

3 Claims, 2 Drawing Sheets

FIG. 1
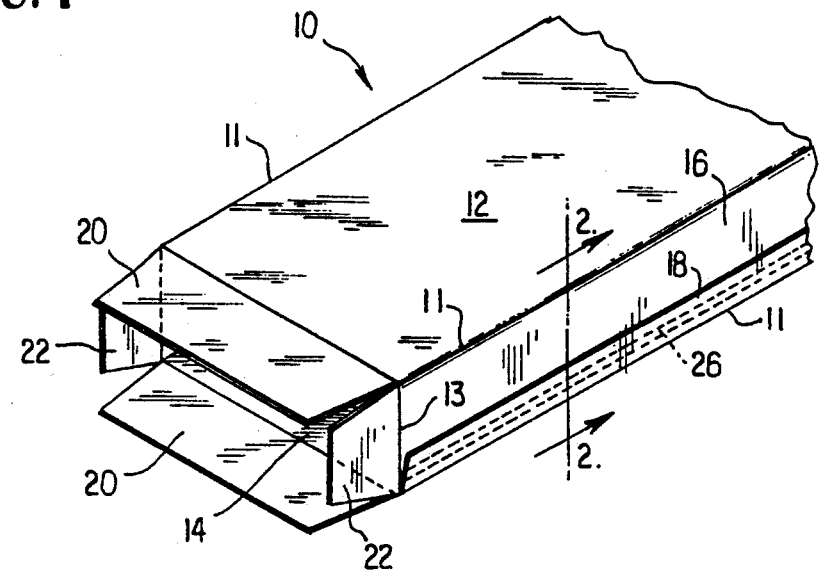
FIG. 2
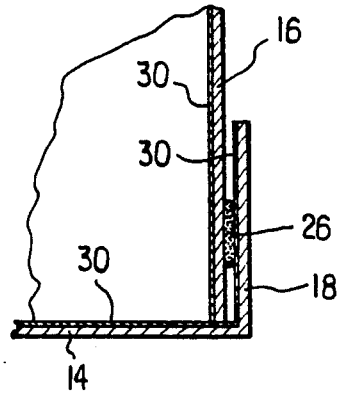
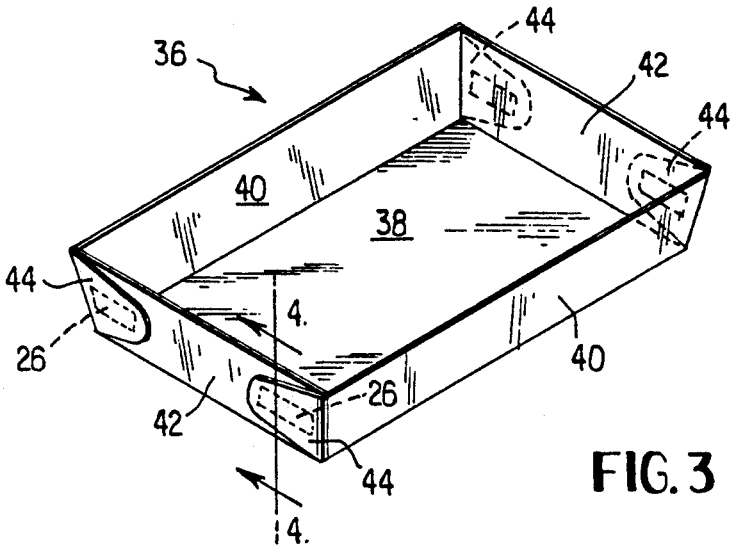
FIG. 3

PAPERBOARD CONTAINER HAVING POLYMETHYLPENTENE COATING

BACKGROUND OF THE INVENTION

This invention relates to paperboard containers for packaging food products such as frozen entrees, pizza, baked goods, brownies, and the like. Containers of this invention are typically formed from a unitary blank of paperboard or other stiff, bendable, and resilient sheet material. It is known that ovenable food trays may be improved, regarding their anti-sticking properties, by coating their food contacting surface with one or more layers of polymethylpentene, an FDA approved material. This is shown in U.S. Pat. No. 5,002,833 issued to Kinsey et al, dated Mar. 26, 1991. In the formation of an ovenable tray of the type disclosed in the Kinsey patent, it is not necessary to form an overlapped, adhesively secured joint.

The use of a polymethylpentene, food contacting layer in food-containing, folded paperboard containers of conventional design with glued seams, corners or end-flaps has not however been practiced because of the difficulty encountered in making the required overlapped joints. Namely, because of its anti-stick characteristic, it is difficult to adhere a polymethylpentene coated surface with any conventional FDA approved adhesive in forming a container for food. Such adhesives are water based, due to the dangers inherent in solvent based adhesives regarding flammability, exposure of workers to solvent vapors, and potential of food contamination from the solvents. While some FDA approved adhesives are solvent based, their use in food containers would require expensive analytical testing methods/apparatus to insure that no residual solvent was in the adhesive at the time the food was placed in the containers.

SUMMARY OF THE INVENTION

At least one surface of a paperboard blank is coated with a laminate which includes a layer of polymethylpentene, the polymethylpentene layer being most remote from the paperboard substrate. The blank is provided with conventional score/fold lines to permit its bending to form a container for food products. According to the practice of this invention, those portions of the polymethylpentene coating which receive adhesive is flame treated prior to the forming of a container from the blank. This treatment permits paperboard container fabricators to form the usual manufacturer's joint common to many containers, as well as any other type of container requiring adhesively secured overlapped edges or overlapped portions. While flame treatment of polymethylpentene to improve its adhesion is known, the use of flame treatment of this material in the environment of seamed paperboard containers for food is not known.

BRIEF DESCRIPTION OF THE DRAWINGS

FIG. 1 is a partial perspective view of a tube type paperboard container formed in accordance with this invention.

FIG. 2 is a view taken along 2—2 of FIG. 1.

FIG. 3 is a view similar to FIG. 1 and shows another type of paperboard container.

DETAILED DESCRIPTION OF THE INVENTION

Figure 4:
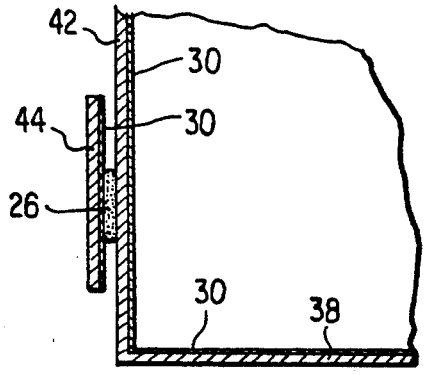
FIG. 4 is a view taken along section 4—4 of FIG. 3.

Referring now to FIG. 1 of the drawings, the numeral 10 denotes generally a paperboard carton or container adapted to contain food and fashioned from a unitary blank of paperboard and coated with a laminate on at least the major part of its inside surface, the laminate including a polymethlypentene layer. Only one end of the container is shown, i being understood that the other end may be the same or different from that illustrated. The blank (shown at FIG. 6) is provided with a plurality of fold or score lines 11 to permit the blank to be folded or erected to form a container. The container shown is known as a tube type container and includes opposite front and rear panels 12 and 14, and side panels 16, only one of which is shown. A manufacturer's flap, integral with rear panel 14, is denoted as 18 and is adhesively secured to one portion of a side panel 16. The manufacturer's flap 18 may be on the outside of the container as shown in FIG. 1, but in some cases it may be on the inside of the container. Elongated end closure flaps 20 are integrally and foldably attached to panels 12 and 14, While shorter end closure flaps 22 are provided on the side panels 16. It will be understood that the other end of the container may be closed by similar closure flaps 20, 22, or by any other closing arrangement.

Referring now to FIG. 2, details of the manufacturer's flap are shown, with a water based adhesive 26 securing manufacturer's flap 18 to a portion of a side panel 16. All of the interior surfaces of the container of FIG. 1, including the interior surfaces of the end closure forming panels 20, 22 are coated with a laminate coating 30 which includes an outer, food-contacting layer of polymethylpentene most remote from the paperboard substrate. Still referring to FIG. 2, it is seen that adhesive 26 adheres to both the polymethylpentene coating on manufacturer's flap 18, and to the right outer surface of end panel 16 which has not been so coated. The seam or joint shown at FIG. 2 is made possible, according to this invention, by flame treating the polymethylpentene layer portions of laminate coating 30 which are involved in the formation of the glued joint. Such flame treatment may be carried out at a place of fabrication of the coated blanks, or alternatively, may be carried out at the place of assembly or erection of the containers from the coated blanks. The flame treatment is confined to the areas of the polymethylpentene layer which are glued with the adhesive. Generally, because the area of flame-treatment cannot be controlled precisely, the flame-treated area will be somewhat greater than the area actually contacting the adhesive 26.

Referring now to FIG. 3 of the drawings, the numeral 36 denotes a tray type container, also typically fashioned from a unitary blank of paperboard coated on its interior or food-contacting surface with a laminate containing one or more layers of polymethylpentene. This container does not contain the usual manufacturer's flap, but does require overlapped and glued paperboard layers. The bottom panel of the tray is designated as 38, with the long side walls designated as 40 and the shorter side walls designated as 42. Flaps 44 are integral with long walls 40, with the inside portions of these flaps being adhesively secured to shorter tray walls 42, as shown at FIG. 4. Adhesive 26 of FIG. 4 is seen to join the polymethylpentene layer of coating 30 on flaps 44 to the left side of sidewalls 42. Again, all of the interior surfaces of the tray are provided with coating 30, as well as the interior surfaces of flaps 44. Only those portions of the polymethylpentene layer glued with adhesive are flame treated. No portions of the food contacting interior surface of the container are flame treated.

It is important that the flame treatment of the polymethylpentene surface be confined generally to those portions of the area of the polymethylpentene layer that are involved in the formation of the glued seams, corners, end-flaps, or other overlapped joints of the paperboard food container. More specifically, it is important that the flame treatment not extend into areas of the blank that will be food-contacting areas on the interior of the container. If such food-contacting areas are flame-treated, the excellent food-release, anti-sticking properties of the polymethylpentene layer are destroyed. Only by controlling the area of flame-treatment so that it is exclusive of the food-contacting areas of the container is it possible to fabricate a glued container that has the food release characteristics afforded by an unaltered polymethylpentene layer. The prior art that is concerned with improving the adhesive receptivity of polymethylpentene does not address a situation where it is also important to maintain the low surface energy required for the release of foods that tend to stick to cooking surfaces.

Figure 5:
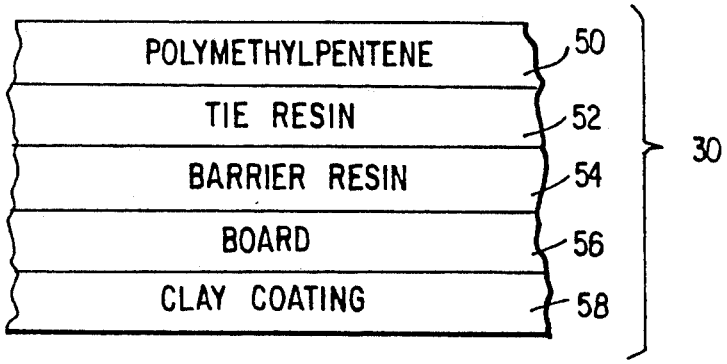
FIG. 5 is a cross sectional view of a typical laminate containing a layer of polymethylpentene coated on a paperboard substrate.

Referring now to FIG. 5, a somewhat schematic view of laminated coating 30 is illustrated. The upper or food-contacting layer of laminated coating 30 is designated as 50 and is a layer of polymethylpentene. A tie resin layer 52 is immediately beneath layer 50, with a barrier layer 54 coated on paperboard substrate 56, such that the paperboard substrate 56 and tie resin layer 52 sandwich the barrier layer 54. Optionally, a conventional clay-filled coating 58 may be applied to the bottom of paperboard substrate 56. If a clay-filled coating such as 58 is employed, it would be on the right hand surface of panel 16 of FIG. 2 and on the left hand surface of wall 42 of FIG. 4, as well as on the right hand surface of manufacturer's flap 18 of FIG. 2 and on the left hand surface of flaps 44 of FIG. 4. The use of a clay-filled coating in the paperboard container art is known, and the presence or absence of such a coating plays no role in this invention.

Figure 6:
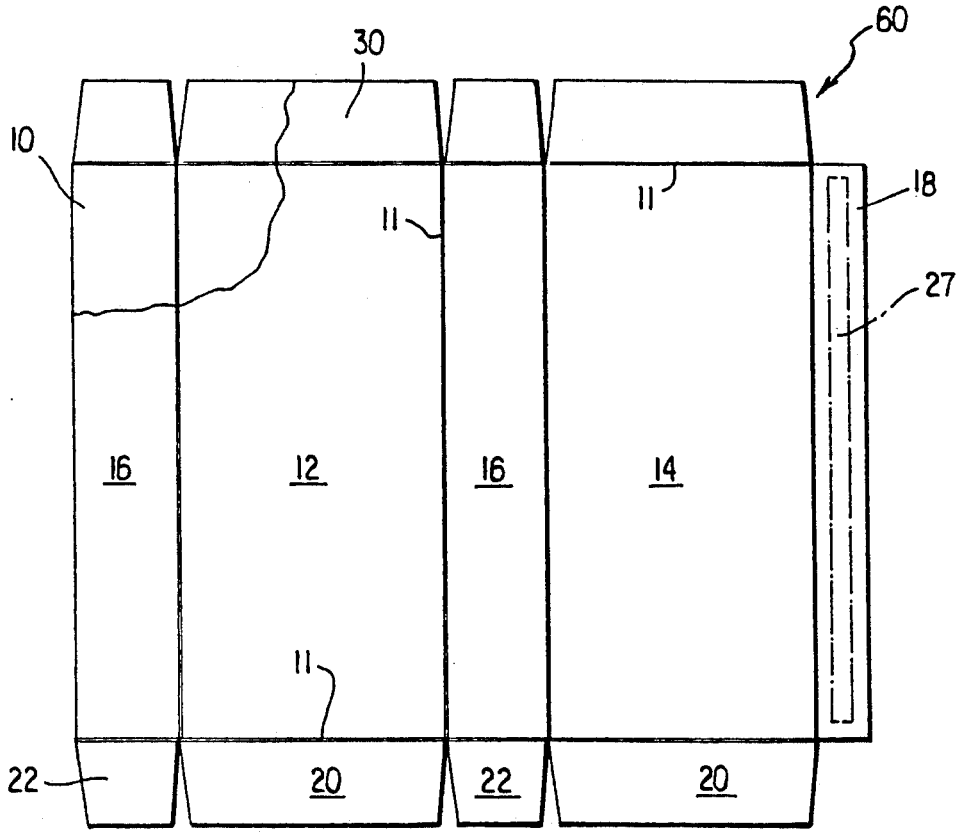
FIG. 6 is a plan view at a unitary, coated paperboard blank for forming the container of FIG. 1.

Referring now to FIG. 6, a blank for forming the container of FIG. 1 is illustrated, the blank denoted as 60. The interior forming surface of the blank faces the reader and is coated with laminate 30. Manufacturer's flap 18 has been flame treated, and this zone or area of flame treatment within flap 18 is denoted as 27. While shown as perfectly rectangular, zone 27 will not be absolutely rectangular. In practice, the adhesive 26 of FIG. 2 will not cover the entire area of zone 27.

The composition and manner of application of layers 50, 52, and 54 to the paperboard substrate 56 are disclosed in the noted patent to Kinsey et al, hereby incorporated by reference. The reader will note that FIG. 5 is taken largely from FIG. 2 of Kinsey et al, with the three layer coextrusion 32 of Kinsey et al corresponding generally to laminate 30 of this invention. Also as shown in Kinsey et al, FIG. 1 thereof illustrates a plural laminate coating including two polymethylpentene layers. A laminate coating such as shown at FIG. 1 of the Kinsey et al patent may also be employed as the coating 30 shown at the present FIG. 5. It will also be understood that a clay-filled coating, similar to coating 58 of FIG. 5, may be used on, in this invention, the lower surface of an extrusion-coated paperboard similar to that shown at FIG. 1 of the Kinsey et al patent.

A specific example of the method of flame treating and of the adhesives which may be employed is as follows. The adhesive 26 was a water based acrylic copolymer, trade designated as Air Products Flexbond 165. Alternatively, a water based vinyl acetate/ethylene/acrylic terpolymer adhesive, trade designated as Flexbond 153, also by Air Products, may be used. The flame was that from a Bunsen burner, with the polymethylpentene layer turned downwards, facing the flame and just above the bright blue flame portion. The polymethylpentene layer was moved at a speed of about one foot per second across the flame. The adhesive was then applied to the flame treated areas, and the opposite side of the paperboard substrate which was coated with a clay-filled coating such as 58, was pressed thereagainst.

We claim:

1. A unitary paperboard blank for forming a food container, said blank provided with a plurality of fold lines to permit it to be folded into a container for a food product, the blank having a laminated coating on at least the major portion of one surface thereof, said coating including a polymethylpentene layer most remote from the paperboard, the blank including a flap coated with said laminate for the formation of an overlapped joint, the flap having a portion of the polymethylpentene layer thereon flame treated, to thereby increase the adhesion of the polymethylpentene layer on said flap to a water based adhesive.

2. A paperboard food container formed from a unitary blank of paperboard, the container having a plurality of flat wall panels integrally joined along fold liens, a flap extending from the edge of one of two adjacent said wall panels, said flap overlapping the second of said two adjacent wall panels to form an overlapped joint, the interior of the container coated over at least a portion thereof with a laminate, that layer of the laminate most remote from the paperboard being of polymethylpentene and forming the interior surface of said container, one surface of said overlapped joint defined by said polymethylpentene layer, a portion of said polymethylpentene layer of said overlapped joint being flame treated, said overlapped joint being secured with a water based adhesive, said water based adhesive contacting both said flame treated polymethylpentene layer of said overlapped joint and a portion of the opposite surface of said unitary blank of paperboard.

3. The container of claim 2 including a food product therein.

* * * * *